US006912267B2

(12) United States Patent
Orsini et al.

(10) Patent No.: US 6,912,267 B2
(45) Date of Patent: Jun. 28, 2005

(54) EROSION REDUCTION FOR EUV LASER PRODUCED PLASMA TARGET SOURCES

(75) Inventors: Rocco A. Orsini, Long Beach, CA (US); Michael B. Petach, Redondo Beach, CA (US); Mark E. Michaelian, Torrance, CA (US); Henry Shields, San Pedro, CA (US); Roy D. McGregor, El Camino Village, CA (US); Steven W. Fornaca, Torrance, CA (US)

(73) Assignee: University of Central Florida Research Foundation, Orlando, FL (US)

( * ) Notice: Subject to any disclaimer, the term of this patent is extended or adjusted under 35 U.S.C. 154(b) by 202 days.

(21) Appl. No.: 10/289,086

(22) Filed: Nov. 6, 2002

(65) Prior Publication Data

US 2004/0086080 A1 May 6, 2004

(51) Int. Cl.[7] ..... H01J 35/00
(52) U.S. Cl. ..... 378/119; 250/504 R; 378/122
(58) Field of Search ..... 378/119–144; 250/504 R, 492.2

(56) References Cited

U.S. PATENT DOCUMENTS 6,002,744 A 12/1999 Hertz et al. ..... 378/119
6,469,310 B1 * 10/2002 Fiedorowicz et al. .. 250/492.22
6,647,088 B1 * 11/2003 Schmidt et al. ..... 378/34

OTHER PUBLICATIONS

Wieland, M.; Wilhein, T.; Faubel, M.; Ellert, Ch.; Schmidt, M.; and Sublemontier, O.;"EUV and Fast Ion Emission from Cryogenic Liquid Jet Target Laser–Generated Plasma" Appl. Phys. B 72, 591–597 (2001)/Digital Object Identifier (DOI) 10.1007/s003400100542.

* cited by examiner

*Primary Examiner*—Craig E. Church
*Assistant Examiner*—Jurie Yun
(74) *Attorney, Agent, or Firm*—John A. Miller; Warn, Hoffmann, Miller & LaLone, P.C.

(57) ABSTRACT

A laser-plasma EUV radiation source (10) that employs one or more approaches for preventing vaporization of material from a nozzle assembly (40) of the source (10) by electrical discharge from the plasma (30). The first approach includes employing an electrically isolating nozzle end, such as a glass capillary tube (46). The tube (46) extends beyond all of the conductive surfaces of the nozzle assembly (40) by a suitable distance so that the pressure around the closest conducting portion of the nozzle assembly (40) is low enough not to support arcing. A second approach includes providing electrical isolation of the conductive portions of the source (40) from the vacuum chamber wall. A third approach includes applying a bias potential (52) to the nozzle assembly (40) to raise the potential of the nozzle assembly (40) to the potential of the arc.

22 Claims, 1 Drawing Sheet

EROSION REDUCTION FOR EUV LASER PRODUCED PLASMA TARGET SOURCES

BACKGROUND OF THE INVENTION

1. Field of the Invention

This invention relates generally to a laser-plasma extreme ultraviolet (EUV) radiation source and, more particularly, to a laser-plasma EUV radiation source that includes a technique for electrically isolating a nozzle of the source from the generated plasma to reduce arcing and nozzle erosion.

2. Discussion of the Related Art

Microelectronic integrated circuits are typically patterned on a substrate by a photolithography process, well known to those skilled in the art, where the circuit elements are defined by a light beam propagating through a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths and higher frequencies. In other words, the resolution of the photolithography process increases as the wavelength of the light source decreases to allow smaller integrated circuit elements to be defined. The current trend for photolithography light sources is to develop a system that generates light in the extreme ultraviolet (EUV) or soft X-ray wavelengths (13–14 nm).

Various devices are known in the art to generate EUV radiation. One of the most popular EUV radiation sources is a laser-plasma, gas condensation source that uses a gas, typically Xenon, as a laser plasma target material. Other gases, such as Argon and Krypton, and combinations of gases, are also known for the laser target material. In the known EUV radiation sources based on laser produced plasmas (LPP), the gas is typically cryogenically cooled in a nozzle to a liquid state, and then forced through an orifice or other nozzle opening into a vacuum chamber as a continuous liquid stream or filament. Cryogenically cooled target materials, which are gases at room temperature, are required because they do not condense on the EUV optics, and because they produce minimal by-products that have to be evacuated by the vacuum chamber. In some designs, the nozzle is agitated so that the target material is emitted from the nozzle as a stream of liquid droplets having a certain diameter (30–100 $\mu$m) and a predetermined droplet spacing.

The low temperature of the liquid target material and the low vapor pressure within the vacuum environment cause the target material to quickly freeze. Some designs employ sheets of frozen cryogenic material on a rotating substrate, but this is impractical for production EUV sources because of debris and repetition rate limitations.

The target stream is illuminated by a high-power laser beam, typically from an Nd:YAG laser, that heats the target material to produce a high temperature plasma which emits the EUV radiation. The laser beam is delivered to a target area as laser pulses having a desirable frequency. The laser beam must have a certain intensity at the target area in order to provide enough heat to generate the plasma.

FIG. 1 is a plan view of an EUV radiation source 10 of the type discussed above including a nozzle 12 having a target material chamber 14 that stores a suitable target material, such as Xenon, under pressure. The chamber 14 includes a heat exchanger or condenser that cryogenically cools the target material to a liquid state. The liquid target material is forced through a narrowed throat portion 16 of the nozzle 12 to be emitted as a filament or stream 18 into a vacuum chamber towards a target area 20. The liquid target material will quickly freeze in the vacuum environment to form a solid filament of the target material as it propagates towards the target area 20. The vacuum environment and vapor pressure within the target material will cause the frozen target material to eventually break up into frozen target fragments, depending on the distance that the stream 18 travels.

A laser beam 22 from a laser source 24 is directed towards the target area 20 to vaporize the target material. The heat from the laser beam 22 causes the target material to generate a plasma 30 that radiates EUV radiation 32. The EUV radiation 32 is collected by collector optics 34 and is directed to the circuit (not shown) being patterned. The collector optics 34 can have any shape suitable for the purposes of collecting and directing the radiation 32, such as a parabolic shape. In this design, the laser beam 22 propagates through an opening 36 in the collector optics 34, as shown. Other designs can employ other configurations.

In an alternate design, the throat portion 16 can be vibrated by a suitable device, such as a piezoelectric vibrator, to cause the liquid target material being emitted therefrom to form a stream of droplets. The frequency of the agitation determines the size and spacing of the droplets. If the target stream 18 is a series of droplets, the laser beam 22 is pulsed to impinge every droplet, or every certain number of droplets.

The target stream 18 provides a certain steady-state pressure of evaporating target material at its location in the vacuum chamber. The pressure within the vacuum chamber decreases the farther away from the target stream 18. This pressure differential defines lines of constant pressure between the plasma 30 and the throat portion 16. Within specific pressure ranges that depend on the target material, these lines of constant pressure provide current or arcing paths from the plasma 30 to the nozzle 12. Electrical discharge arcs are emitted from the plasma 30 to the conductive portions of the nozzle 12 along the lines of constant pressure, and can travel relatively large distances from the plasma 30 to the nozzle 12. If the pressure is too high or too low, then the electrical discharge arcs cannot be supported. Additionally, fast atoms emitted from the target material and solid pieces of excess, unvaporized target material can impact the nozzle 12.

The electrical discharge arcs from the plasma 30 cause the nozzle material to melt or vaporize, creating nozzle damage and excess debris in the chamber. Also, the fast atoms and excess target material erode the nozzle 12. The generation of this debris also causes damage to the optical elements and other components of the source resulting in increased process costs. Each one of the above-mentioned debris generation mechanisms must be addressed in order to effectively minimize source debris generation.

SUMMARY OF THE INVENTION

In accordance with the teachings of the present invention, a laser-plasma EUV radiation source is disclosed that employs one or more approaches for eliminating erosion of and vaporization of material from a nozzle of the source by electrical discharge and arcing generated by the plasma. A first approach includes employing a non-conductive nozzle outlet end, such as a glass capillary tube, that will not conduct the arc. The nozzle outlet end extends beyond all of the conductive surfaces of the nozzle towards the plasma by a suitable distance so that the pressure in the chamber around the closest conductive portion of the nozzle to the plasma is low enough so that it does not support arcing. A second approach includes providing electrical isolation of the conductive portions of the nozzle from the vacuum chamber wall. A third approach includes applying a bias potential to the nozzle to raise the potential of the nozzle to the potential of the arc to inhibit current flow.

Additional objects, advantages and features of the present invention will become apparent from the following description and appended claims, taken in conjunction with the accompanying drawings.

DETAILED DESCRIPTION OF THE EMBODIMENTS

The following discussion of the embodiments of the invention directed to an EUV radiation source including a nozzle that prevents plasma arcing is merely exemplary in nature, and is in no way intended to limit the invention or its applications or uses.

Figure 1:
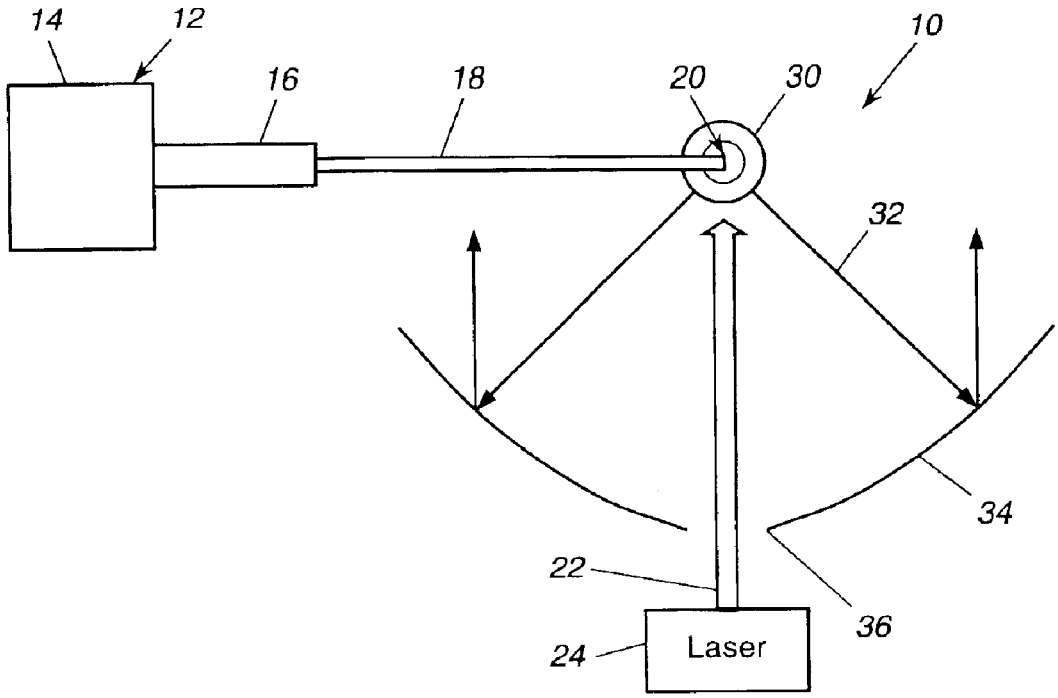
FIG. 1 is a plan view of an EUV radiation source.
Figure 2:
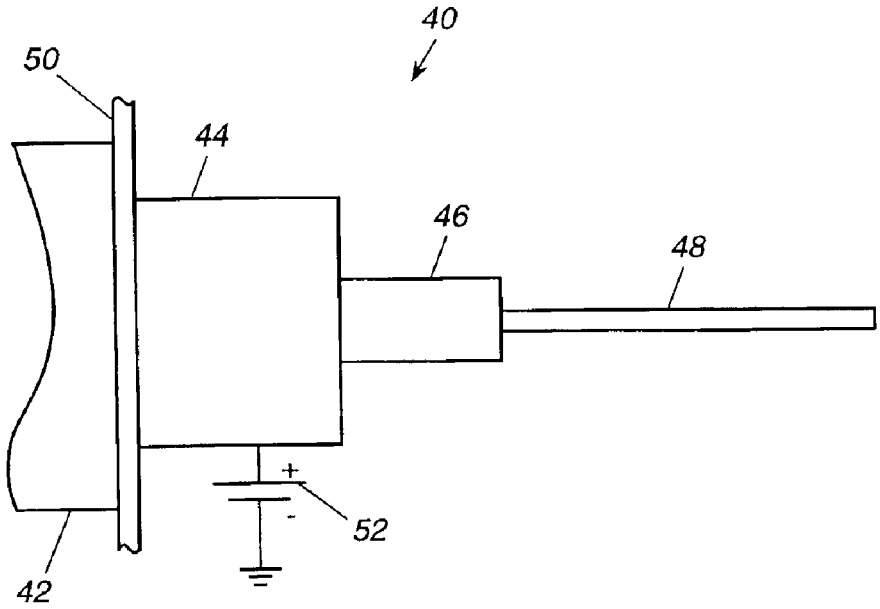
FIG. 2 is a plan view of a nozzle for the EUV radiation source shown in FIG. 1, according to an embodiment of the present invention.

FIG. 2 is a plan view of a nozzle assembly 40 applicable to replace the nozzle 12 in the source 10 discussed above, according to an embodiment of the present invention. The nozzle assembly 40 includes a target material chamber 42 that cryogenically cools the target material to a liquid state and holds it under pressure. The nozzle assembly 40 also includes a nozzle outlet tube 46 that is mounted to the chamber 42 by suitable mounting hardware 44, where the target material is forced through the tube 46. The tube 42 extends through the mounting hardware 44 and is in fluid communication with the chamber 42. A target material filament stream 48 is emitted from the tube 46 and quickly freezes in the chamber. The frozen filament stream 48 is vaporized by the laser beam 22 to generate the EUV radiation 32, as discussed above.

According to the invention, the nozzle outlet tube 46 is made of a non-conductive material so that electrical discharge and arcing from the plasma 30 is not attracted to the tube 46, and thus does not damage the nozzle assembly 40. In one embodiment, the tube 16 is a capillary tube made of glass or ceramic. However, this is by way of a non-limiting example in that other non-conductive materials can be employed. Further, other non-conductive nozzle components, such as an orifice plate, can be provided closest to the target area 20 to prevent arcing.

The closest conductive portion of the nozzle assembly 40 to the plasma 30 is the mounting hardware 44. According to the invention, the mounting hardware 44 is set back far enough from the plasma 30 so that it is in a region of the chamber having a pressure that is too low to support electrical discharges from the plasma 30. In other words, because the arcs from the plasma 30 must travel through a region within the chamber that has sufficient pressure, the arcs will not hit the mounting hardware 44 because the pressure around the mounting hardware 44 is too low. In other designs, the closest conductive portion of the nozzle assembly 40 may not be the mounting hardware 44, but may be another conductive portion of the nozzle assembly 40 which also would be positioned in a low pressure region of the chamber.

In one example, the outlet end of the tube 46 extends beyond all of the conductive surfaces of the nozzle assembly 40 by a sufficient distance, such as 0.1 inch. This distance is set based on the pressure in the vacuum chamber and the type of target material, such as Xenon. In an EUV production chamber, the gas pressure that results from evaporation of the liquid or solid target material will be confined predominantly to the region beyond (downstream of) the opening of the tube 46. The pressure adjacent to the tube 46 should be insufficient to allow an arc to be established between the plasma 30 and the mounting hardware 44.

According to another embodiment of the present invention, the nozzle assembly 40 includes a non-conductive mounting plate 50 mounted to the chamber wall to electrically isolate the nozzle assembly 40 from the chamber wall, which is typically at ground. Thus, no conductive portion of the nozzle assembly 40 directly contacts the chamber wall. By breaking the current path from the nozzle assembly 40 to the chamber wall, arcing from the plasma 30 will not damage the nozzle assembly 40. The plate 50 can be any non-conductive isolation member that breaks the electrical continuity between the mounting hardware 44 and the chamber wall. In this design, the tube 46 can be conductive because the mounting plate 50 prevents current from the arcs from traveling through the tube 46. As will be appreciated by those skilled in the art, the plate 50 can be made of any suitable non-conductive material, such as glass, and can be positioned at any convenient location in the structural configuration of the nozzle assembly 40 to break the conductive path of the current resulting from electrical discharge from the plasma 30.

In yet another embodiment of the invention, a DC bias source 52 is electrically coupled to the mounting hardware 44, or another conductive portion of the nozzle assembly 40, to raise the potential of the nozzle assembly 40 to the potential of the arc. By raising the electric potential of the nozzle assembly 40 to the electric potential of the electrical discharge, no current flows into the nozzle assembly 40 from the arcs. In order to be effective, the voltage potential of the arc would have to be known, so the appropriate DC bias potential could be applied to the nozzle assembly 40.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. An extreme ultraviolet (EUV) radiation source for generating EUV radiation, said source comprising:

a source nozzle for emitting a target material stream to a target area, said nozzle including a non-conductive portion, wherein the non-conductive portion is a capillary tube from which the target material stream is emitted; and a laser source emitting a laser beam, said laser beam impinging the target material at the target area to create a plasma that emits the EUV radiation, said non-conductive portion of the nozzle being designed to prevent electrical discharge generated by the plasma from damaging the nozzle.

2. The source according to claim 1 wherein the non-conductive portion is closer to the target area than any conductive portion of the nozzle.

3. The source according to claim 2 wherein the closest conductive portion of the nozzle to the target area is in a portion of a vacuum chamber at a low enough pressure that does not support electrical discharge.

4. The source according to claim 1 wherein the capillary tube is made of a material selected from the group consisting of glass and ceramic.

5. The source according to claim 1 wherein the capillary tube is mounted to the nozzle by a conductive mounting hardware.

6. An extreme ultraviolet (EUV) radiation source for generating EUV radiation, said source comprising:

a source nozzle, said nozzle including a source material chamber for holding a target material, said nozzle further including a non-conductive capillary tube mounted to the material chamber by a conductive mounting hardware, said capillary tube emitting a target material stream from the nozzle to a target area; and a laser source, said laser source emitting a laser beam that impinges the target material stream at the target area to create a plasma that emits the EUV radiation, said capillary tube preventing electrical discharge generated by the plasma from damaging the nozzle.

7. The source according to claim 6 wherein the capillary tube is made of a material selected from the group consisting of glass and ceramic.

8. The source according to claim 6 wherein the mounting hardware is located in a portion of a source vacuum chamber that is at a low enough pressure that it does not support the electrical discharge from the plasma.

9. An extreme ultraviolet (EUV) radiation source for generating EUV radiation, said source comprising:

a source nozzle for emitting a target material stream to a target area, said nozzle including an electrically isolating structure that electrically isolates the nozzle from a chamber wall of the source, wherein the electrically isolating structure is a mounting structure that mounts the nozzle to the chamber wall; and a laser source, said laser source emitting a laser beam that impinges the target material stream at the target area to create a plasma that emits the EUV radiation, said electrically isolating structure preventing electrical discharge generated by the plasma from damaging the nozzle.

10. An extreme ultraviolet (EUV) radiation source for generating EUV radiation, said source comprising:

a source nozzle for emitting a target material stream to a target area, said nozzle including a bias source applying a bias potential to a conductive portion of the nozzle; and a laser source emitting a laser beam, said laser beam impinging the target material stream at the target area to create a plasma that emits the EUV radiation, said bias source preventing current flow through the source nozzle from an electrical discharge generated by the plasma.

11. The source according to claim 10 wherein the bias source is a DC bias source that provides a bias potential substantially equal to a bias potential of the electrical discharge.

12. The source according to claim 10 wherein the bias source is electrically coupled to mounting hardware of the source nozzle, said mounting hardware mounting a capillary tube to the nozzle.

13. A method for protecting a nozzle of an extreme ultraviolet (EUV) radiation source from electrical discharge created by a plasma generated by the source, comprising:

emitting a target material stream from the nozzle to a target area;

emitting a laser beam from a laser source to the target area, said laser beam vaporizing the target material stream to create the plasma; and preventing the electrical discharge created by the plasma from damaging the nozzle, wherein preventing the electrical discharge created by the plasma from damaging the nozzle includes providing a mounting structure that mounts the nozzle to a chamber wall of the source that prevents a current flow from propagating through the nozzle.

14. The method according to claim 13 wherein preventing the electrical discharge created by the plasma from damaging the nozzle further includes making a portion of the nozzle closest to the target area out of a non-conductive material.

15. The method according to claim 14 wherein the non-conductive portion is a nozzle tip emitting the target material stream.

16. The method according to claim 15 wherein the nozzle tip is made of a material selected from the group consisting of glass and ceramic.

17. A method for protecting a nozzle of an extreme ultraviolet (EUV radiation) source from electrical discharge created by a plasma generated by the source, comprising:

emitting a target material stream from the nozzle to a target area;

emitting a laser beam from a laser source to the target area, said laser beam vaporizing the target material stream to create the plasma; and preventing the electrical discharge created by the plasma from damaging the nozzle, wherein preventing the electrical discharged created by the plasma from damaging the nozzle includes applying a bias potential to a conductive portion of the nozzle for equalizing the electrical discharge.

18. The method according to claim 17 wherein preventing the electrical discharge created by the plasma from damaging the nozzle includes making a portion of the nozzle closest to the target area out of a non-conductive material.

19. The method according to claim 17 wherein the non-conductive portion is a nozzle tip emitting the target material stream.

20. The method according to claim 17 wherein the nozzle tip is made of a material selected from the group consisting of glass and ceramic.

21. A method for protecting a nozzle of an extreme ultraviolet (EUV) radiation source from electrical discharge created by a plasma generated by the source, comprising:

emitting a target material stream from the nozzle to a target area;

emitting a laser beam from a laser source to the target area, said laser beam vaporizing the target material stream to create the plasma; and preventing the electrical discharge created by the plasma from damaging the nozzle, wherein preventing the electrical discharge created by the plasma from damaging the nozzle includes providing a non-conductive capillary tube from which the target material stream is emitted.

22. The method according to claim 21 wherein the capillary tube is made of a material selected from the group consisting of glass and ceramic.

* * * * *